US010725403B2

(12) United States Patent
Tamaki et al.

(10) Patent No.: US 10,725,403 B2
(45) Date of Patent: Jul. 28, 2020

(54) IMAGE FORMING APPARATUS

(71) Applicant: CANON KABUSHIKI KAISHA, Tokyo (JP)

(72) Inventors: Masayuki Tamaki, Kashiwa (JP); Hiroto Ito, Tokyo (JP); Oki Kitagawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/560,484

(22) Filed: Sep. 4, 2019

(65) Prior Publication Data

US 2020/0081382 A1 Mar. 12, 2020

(30) Foreign Application Priority Data

Sep. 10, 2018 (JP) ..... 2018-168998

(51) Int. Cl.
*G03G 15/20* (2006.01)
*G03G 15/00* (2006.01)

(52) U.S. Cl.
CPC ..... *G03G 15/2017* (2013.01); *G03G 15/2039* (2013.01); *G03G 15/5016* (2013.01)

(58) Field of Classification Search
CPC .... G03G 15/55; G03G 15/206; G03G 15/553; G03G 15/2017; G03G 15/2053; G03G 2221/16; G03G 2221/1639; G03G 2221/1663; G03G 2221/1666; G03G 2221/1678; G03G 2221/1684; G03G 2215/2003
See application file for complete search history.

(56) References Cited

U.S. PATENT DOCUMENTS 5,950,038 A 9/1999 Okui
6,070,028 A 5/2000 Odagawa et al.
(Continued)

FOREIGN PATENT DOCUMENTS

JP 2003-021991 A 1/2003
JP 2003-202727 A 7/2003
(Continued)

OTHER PUBLICATIONS

Copending, unpublished, U.S. Appl. No. 16/704,757 to Tsuyoshi Ogawa, filed Dec. 5, 2019.
(Continued)

*Primary Examiner* — Thomas S Giampaolo, II
(74) *Attorney, Agent, or Firm* — Venable LLP

(57) ABSTRACT

An image forming apparatus includes an image forming portion, an image heating apparatus including an image heating unit, a rotatable pressing roller, and an information storing portion; a reading portion; a counter portion; a display portion; and a controller. The controller controls the counter portion so that a) when the image heating apparatus mounted is exchanged with an image heating apparatus including a new image heating unit, on the basis of information of the information storing portion, the count value of the image heating apparatus, the count value of the image heating unit and the count value of the rotatable pressing member are reset, and b) when only the image heating unit mounted is exchanged with a new one, the count value of the image heating unit is reset and the count value of the rotatable pressing member is not reset.

11 Claims, 4 Drawing Sheets

(56) References Cited

U.S. PATENT DOCUMENTS

| | | | | |
|---|---|---|---|---|
| 6,701,096 | B2 | 3/2004 | Arai et al. | |
| 9,563,163 | B2 | 2/2017 | Tanaka et al. | |
| 2008/0008482 | A1* | 1/2008 | Kurita | G03G 15/2064 399/33 |
| 2009/0316232 | A1 | 12/2009 | Ikeda | |
| 2010/0322667 | A1 | 12/2010 | Kitagawa | |
| 2011/0305473 | A1 | 12/2011 | Tamaki | |
| 2012/0027444 | A1 | 2/2012 | Kitagawa | |
| 2012/0107002 | A1 | 5/2012 | Nakayama et al. | |
| 2013/0051830 | A1 | 2/2013 | Tamaki et al. | |
| 2013/0051831 | A1 | 2/2013 | Shinagawa et al. | |
| 2013/0058672 | A1 | 3/2013 | Takada et al. | |
| 2013/0129364 | A1 | 5/2013 | Kitagawa et al. | |
| 2013/0142532 | A1 | 6/2013 | Kitagawa et al. | |
| 2013/0164015 | A1 | 6/2013 | Kawai et al. | |
| 2013/0206745 | A1 | 8/2013 | Tanaka et al. | |
| 2013/0287460 | A1 | 10/2013 | Kitagawa | |
| 2014/0105658 | A1 | 4/2014 | Tamaki | |
| 2015/0037055 | A1 | 2/2015 | Kitagawa et al. | |
| 2015/0212473 | A1 | 7/2015 | Kitagawa et al. | |
| 2015/0338794 | A1 | 11/2015 | Kitagawa et al. | |
| 2016/0026124 | A1 | 1/2016 | Tamaki et al. | |
| 2016/0029435 | A1 | 1/2016 | Kakubari et al. | |
| 2016/0070225 | A1 | 3/2016 | Akiyama et al. | |
| 2016/0085189 | A1 | 3/2016 | Arimoto et al. | |
| 2016/0116867 | A1 | 4/2016 | Kitagawa et al. | |
| 2016/0202649 | A1 | 7/2016 | Asaka et al. | |
| 2017/0060051 | A1 | 3/2017 | Tamaki et al. | |
| 2017/0205744 | A1 | 7/2017 | Tanaka et al. | |
| 2018/0150004 | A1 | 5/2018 | Tanaka et al. | |
| 2018/0348681 | A1 | 12/2018 | Yamaguchi et al. | |
| 2018/0348683 | A1 | 12/2018 | Fukamachi et al. | |
| 2019/0317442 | A1* | 10/2019 | Nishinoue | G03G 15/553 |
| 2020/0033767 | A1* | 1/2020 | Adachi | G03G 15/2039 |
| 2020/0033775 | A1* | 1/2020 | Inoue | G05D 23/24 |
| 2020/0033784 | A1 | 1/2020 | Takada et al. | |

FOREIGN PATENT DOCUMENTS

| | | | |
|---|---|---|---|
| JP | 2004-085593 | A | 3/2004 |
| JP | 2012-053332 | A | 3/2012 |
| JP | 2017-156546 | A | 9/2017 |
| RU | 2428734 | C2 | 9/2011 |

OTHER PUBLICATIONS

European Search Report, dated Mar. 3, 2020, in corresponding European Application No. 19194540.1.

Decision to Grant a Patent for Invention, dated May 22, 2020, issued in corresponding Russian Application No. 2019-127663.

* cited by examiner

IMAGE FORMING APPARATUS

FIELD OF THE INVENTION AND RELATED ART

The present invention relates to an image forming apparatus of an electrophotographic type or an electrostatic recording type, for example.

Conventionally, the image forming apparatus of the electrophotographic type has been widely used as a copying machine, a printer, a plotter, a facsimile machine, a multifunction machine having a plurality of functions of these machines, or the like. In such an image forming apparatus, a type in which a toner image formed and carried on an image bearing member by using an electrophotographic process is transferred onto a sheet which is a recording material and then the toner image is fixed on the sheet by heating and pressing the sheet by a fixing device has been widely used.

Such a fixing device is mounted as a unit so as to be mountable and dismountable from an apparatus main assembly of the image forming apparatus, and for example, it is desired that the fixing device is exchanged, for example, in the case where abrasion of a fixing belt or a pressing roller progresses and a lifetime of the fixing belt or the pressing roller reaches an end thereof. For this reason, an image forming apparatus in which a counter for discriminating whether or not the fixing belt resets the end of the lifetime thereof is provided and exchange of the fixing belt is prompted by making discrimination that the fixing belt reaches an end thereof in the case where a count value of the counter resets a predetermined value has been proposed (Japanese Laid-Open Patent Application (JP-A) 2012-53332). In this image forming apparatus, for example, the counter is increased in value by a predetermined amount on the basis of a sheet size, a sheet kind, the number of sheets and a direction of printing.

Further, a technique for resetting a counter with exchange of a fixing device has also been developed. For example, an image forming apparatus in which a fuse is provided to consumables such as the fixing device the counter of the fixing device is reset by causing a fuse blowout through energization from an apparatus main assembly side when the fixing device is mounted in the apparatus main assembly has been proposed (JP-A 2003-21991). In this case, the fuse functions as a storing portion for storing whether or not the fixing device is a new article. As a result, when the fixing device is mounted in the apparatus main assembly, a on the basis of the storing portion, i.e., on the basis of the blowout of the fuse, discrimination that the fixing device is not the new article can be made. For this reason, by continuously using the counter of the fixing device without resetting the counter, it is possible to prevent erroneous reset of the counter.

In recent years, as the fixing device, a fixing device such that each of a fixing member such as a fixing film and a pressing member such as a pressing roller is made mountable and dismountable from the fixing device has been developed. According to this fixing device, not only an entirety of the fixing device is exchanged with respect to the apparatus main assembly, but also the fixing member and the pressing member can be independently exchanged with respect to the fixing device. In this case, use amounts which are lifetimes of the fixing device, the fixing member and the pressing member are different from each other, and therefore, separate counters are provided for the fixing device, the fixing member and the pressing member, respectively. Here, when storing portions are separately provided for the fixing device, the pressing roller and a fixing film unit, respectively, a cost of component parts increases. For this reason, for example, it would be considered that only the fixing film unit which is relatively shorter in lifetime than the fixing device and the pressing roller is provided with a storing portion for storing whether or not the fixing film unit is a new article.

Thus, in the case where a plurality of exchange directions exist, when the storing portion is provided, exchange can be known and therefore, the counter can be reset when the image forming apparatus detects the exchange. On the other hand, as regards the member which is not provided with the storing portion, the counter is reset manually every time when the exchange is made. In a constitution in which the counter is reset manually also in the case where the entirety of the fixing device is exchanged, there is a liability of a lowering in usability.

SUMMARY OF THE INVENTION

A principal object of the present invention is to provide an image forming apparatus capable of improving usability during exchange of a component part.

According to an aspect of the present invention, there is provided an image forming apparatus comprising: an image forming portion configured to form a toner image on a recording material; an image heating apparatus mountable in and dismountable from the image forming apparatus and configured to heat the toner image formed on the recording material, wherein the image heating apparatus includes, i) an image heating unit which is provided in the image heating apparatus so as to be mountable in and dismountable from the image heating apparatus and which includes a rotatable heating member configured to heat the toner image formed on the recording material, ii) a rotatable pressing roller provided in the image heating apparatus so as to be mountable in and dismountable from the image heating apparatus and configured to press the rotatable heating member so as to form a nip in which the recording material is nipped and fed, and iii) an information storing portion provided on the image heating unit so as to be mountable in and dismountable from the image heating apparatus integrally with the image heating unit, a reading portion configured to read information of the information storing portion; a counter portion configured to count a value relating to a use amount of the image heating apparatus mounted, a value of a use amount of the image heating unit mounted, and a value of a use amount of the rotatable pressing member mounted; a display portion configured to display a count value of the image heating apparatus, a count value of the image heating unit, and a count value of the rotatable pressing member; and a controller configured to control the counter portion so that when the image heating apparatus mounted is exchanged with an image heating apparatus including a new image hating unit, on the basis of information of the information storing portion, the count value of the image heating apparatus, the count value of the image heating unit and the count value of the rotatable pressing member are reset, and when only the image heating unit mounted is exchanged with a new image heating unit, the count value of the image heating unit is reset and the count value of the rotatable pressing member is not reset.

Further features of the present invention will become apparent from the following description of exemplary embodiments with reference to the attached drawings.

DESCRIPTION OF EMBODIMENTS

In the following, an embodiment of an image forming apparatus which is an example of the present invention will be specifically described with reference to FIGS. 1-4. In this embodiment, as the example of an image forming apparatus 1, a full-color printer of a tandem type is described. However, the present invention is not limited to the image forming apparatus 1 of the tandem type in which a fixing device is mounted, but may also be an image forming apparatus of another type in which the fixing device is mounted. Further, the image forming apparatus 1 is not limited to the full-color image forming apparatus, but may also be a monochromatic image forming apparatus or a single-color image forming apparatus. Or, the image forming apparatus 1 can be carried out in various uses such as printers, various printing machines, copying machines, facsimile machines and multi-function machines.

Figure 1:
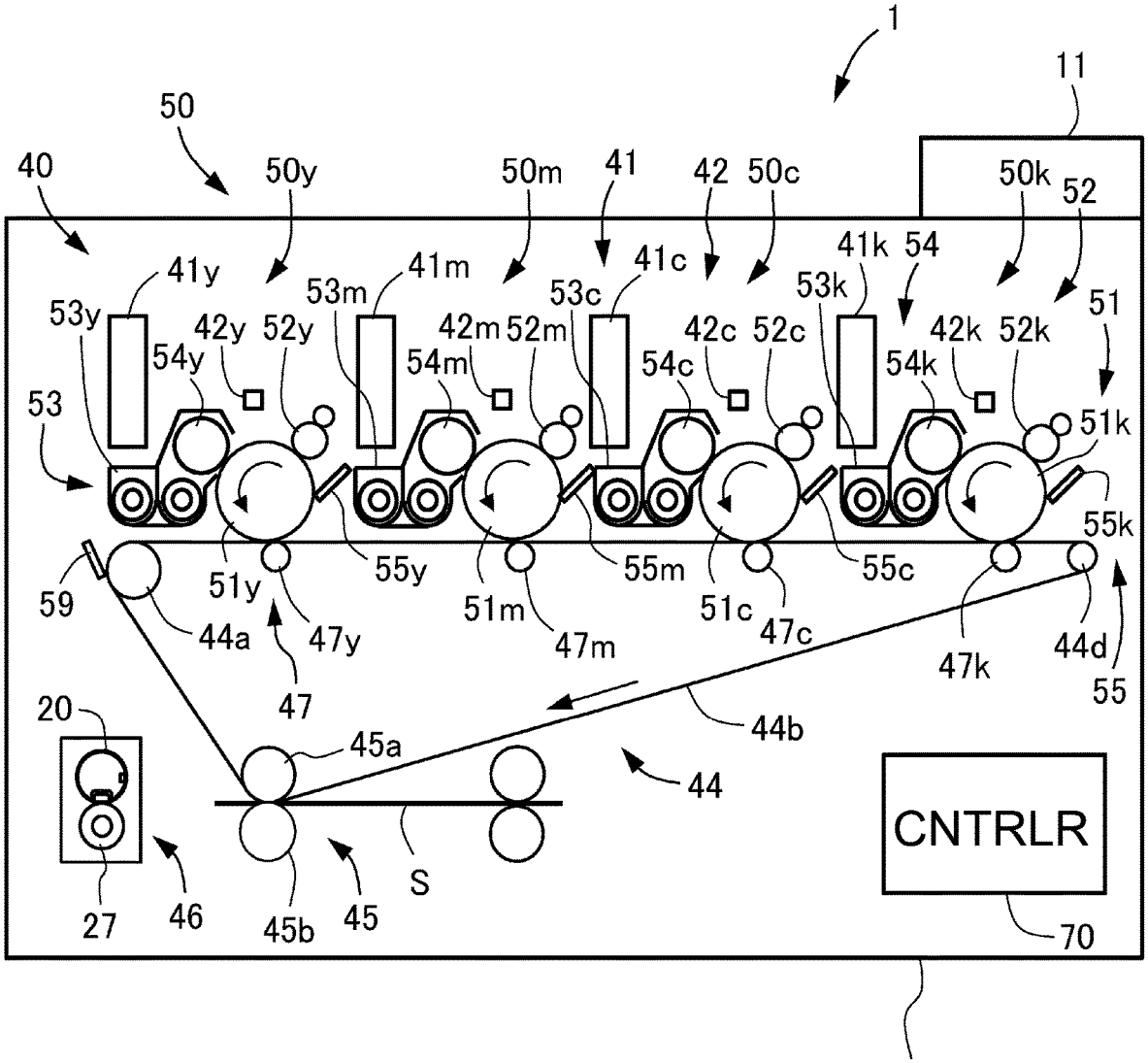
FIG. 1 is a sectional view showing a schematic structure of an image forming apparatus according to an embodiment of the present invention.

As shown in FIG. 1, the image forming apparatus 1 includes an apparatus main assembly 10, an unshown sheet feeding portion, an image forming portion 40, a controller 70 and an operating portion 11. The image forming apparatus 1 is capable of forming a four-color-based full-color image on a recording material depending on an image signal from an unshown host device such as an original reading device or a personal computer or from an unshown external device such as a digital camera or a smartphone. Incidentally, on a sheet S which is the recording material, a toner image is to be formed, and specific examples of the sheet S include plain paper, a synthetic resin sheet as a substitute for the plain paper, thick paper, a sheet for an overhead projector, and the like.

[Image Forming Portion]

The image forming portion 40 is capable of forming an image, on the basis of image information on the sheet S fed from the sheet feeding portion. The image forming portion 40 includes image forming units 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, a secondary transfer portion 45 and a fixing device 46. Incidentally, the image forming apparatus 1 of this embodiment is capable of forming a full-color image and includes the image forming units 50*y* for yellow (y), 50*m* for magenta (m), 50*c* for cyan (c) and 50*k* for black (k), which have the same constitution and which are provided separately. For this reason, in FIG. 1, respective constituent elements for four colors are shown by adding associated color identifiers to associated reference numerals, but in the specification, the constituent elements are described using only the reference numerals without adding the color identifies in some cases.

The image forming unit 50 includes a photosensitive drum 51 movable while carrying a toner image, a charging roller 52, a developing device 53 and a cleaning blade 55. The image forming unit 50 is integrally assembled into a unit as a process cartridge and is constituted so as to be mountable and dismountable from the apparatus main assembly 10, so that the image forming unit 50 forms the toner image on an intermediary transfer belt 44*b* described later.

The photosensitive drum 51 is rotatable and carries an electrostatic image used for image formation. In this embodiment, the photosensitive drum 51 is a negatively chargeable organic photoconductor (OPC) of 30 mm in outer diameter and is rotationally driven at a predetermined process speed (peripheral speed) in an arrow direction by an unshown motor. As each of the charging rollers 52*y*, 52*m*, 52*c* and 52*k*, a rubber roller rotated by the photosensitive drum 51 in contact with a surface of the photosensitive drum 51 is used and electrically charges the surface of the photosensitive drum 51 uniformly. The exposure device 42 is a laser scanner and emits laser light in accordance with image information of separated color outputted from the controller 70.

The developing devices 53*y*, 53*m*, 53*c* and 53*k* include developing sleeves 54*y*, 54*m*, 54*c* and 54*k*, respectively, and each of the developing devices 53 develops, with toner, the electrostatic image formed on the photosensitive drum 51 by applying thereto a developing bias. The developing device 53 not only accommodates the developer supplied from a toner bottle 41 but also develops the electrostatic image formed on the photosensitive drum 51. The developing sleeve 54 is constituted by a non-magnetic material, for example, aluminum, non-magnetic stainless steel or the like, and is made of aluminum in this embodiment. Inside the developing sleeve 54, a roller-shaped magnet roller is fixedly provided in a non-rotatable state relative to a developer container. The developing sleeve 54 carries a developer including non-magnetic toner and a magnetic carrier and feeds the developer to a developing region opposing the photosensitive drum 51.

The toner image formed on the surface of the photosensitive drum 51 is primary-transferred onto the intermediary transfer unit 44. That is, the photosensitive drum 51 supplies the toner to the intermediary transfer belt 44*b*, so that the toner image can be carried on the intermediary transfer belt 44*b*. Cleaning blades 55*y*, 55*m*, 55*c* and 55*k* are of a counter blade type and are contacted to the photosensitive drums 51*y*, 51*m*, 51*c* and 51*k*, respectively, with predetermined pressing forces. After the primary transfer, the toner remaining on the photosensitive drum 51 without being transferred onto the intermediary transfer unit 44 is removed by the cleaning blade 55 provided in contact with the photosensitive drum 51, and then the photosensitive drum 51 prepares for a subsequent image forming process.

The intermediary transfer unit 44 includes a plurality of rollers including a driving roller 44*a*, a follower roller 44*d* and the primary transfer rollers 47*y*, 47*m*, 47*c* and 47*k* and includes the intermediary transfer belt 55*b* wound around these rollers and moving while carrying the toner images. The primary transfer rollers 47*y*, 47*m*, 47*c* and 47*k* are disposed opposed to the photosensitive drums 51*y*, 51*m*, 51*c* and 51*k*, respectively, and contact the intermediary transfer belt 44*b*, so that the primary transfer rollers 47 primary-transfer the toner images from the photosensitive drums 51 onto the intermediary transfer belt 44*b*.

The intermediary transfer belt 44*b* contacts the photosensitive drum 51 and forms a primary transfer portion between itself and the photosensitive drum 51, and primary-transfers the toner image, formed on the photosensitive drum 51, at the primary transfer portion by being supplied with a primary transfer bias. By applying a positive primary transfer bias to the intermediary transfer belt 44*b* through the primary transfer rollers 47, negative toner images on the photosensitive drums 51 are multiple-transferred successively onto the intermediary transfer belt 44*b*. The intermediary transfer belt 44*b* is provided with a belt cleaning device 59 for removing transfer residual toner on the intermediary transfer belt 44*b*.

The secondary transfer portion 45 includes an inner secondary transfer roller 45*a* and an outer secondary transfer roller 45*b*. The outer secondary transfer roller 45*b* contacts the intermediary transfer belt 44*b*, and in a nip between itself and the intermediary transfer belt 44*b*, a secondary transfer bias of an opposite polarity to the charge polarity of the toner is applied to the outer secondary transfer roller 45*b*. As a result, the outer secondary transfer roller 45*b*, collectively secondary-transfers the toner images from the intermediary transfer belt 44*b* onto the sheet S supplied to the nip.

The fixing device 46 includes a fixing film unit 20 and a pressing roller 27. The sheet S is nipped and fed between a fixing film 21 (FIG. 3) of the fixing film unit 20 and the pressing roller 27 and is conveyed in a sheet feeding direction, whereby the toner image transferred and formed on the sheet S is heated and pressed and is fixed on the sheet S. Details of the fixing device 46 will be described later.

[Controller]

Figure 2:
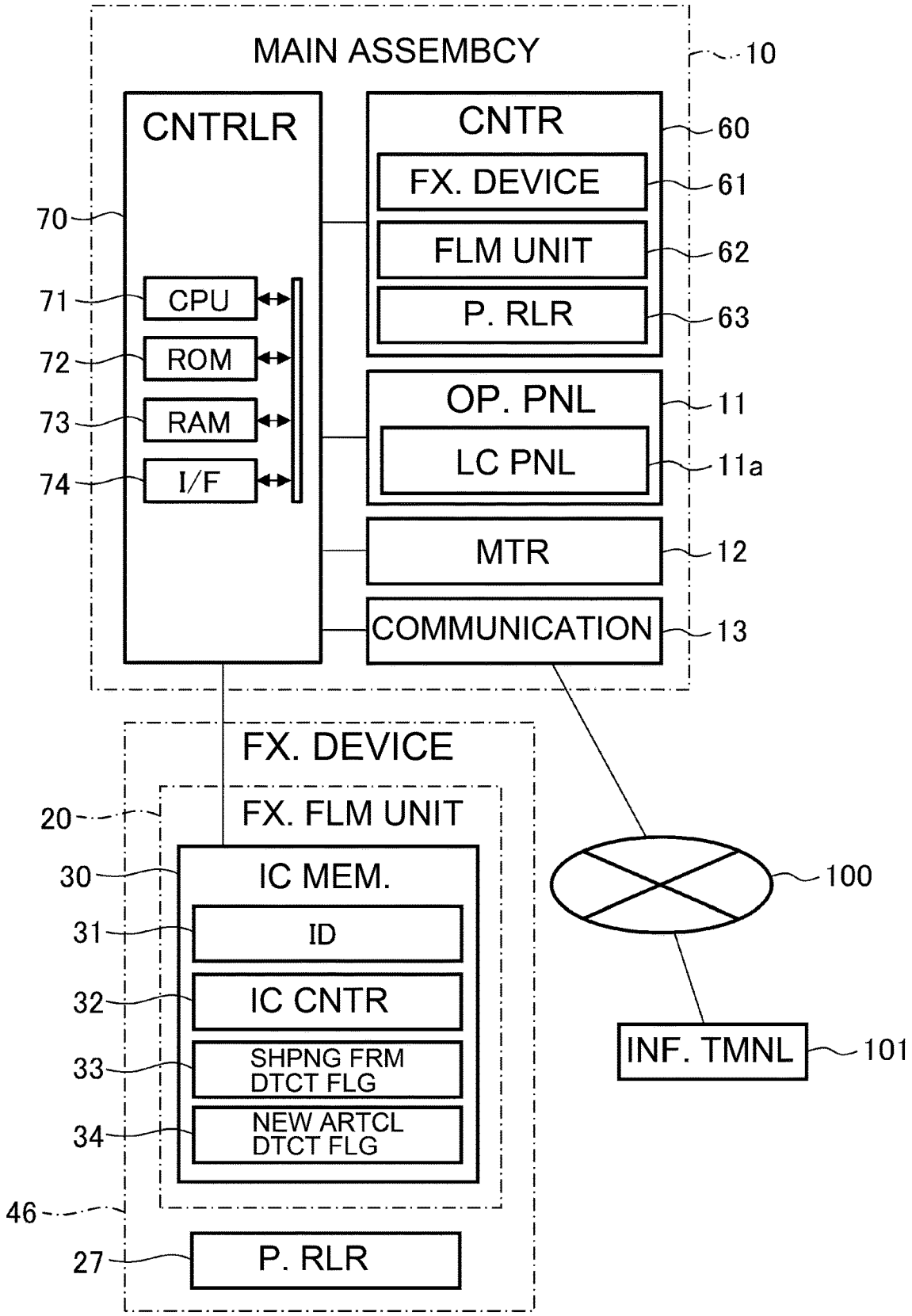
FIG. 2 is a schematic control block diagram of the image forming apparatus according to the embodiment.

As shown in FIG. 2, the controller 70 is constituted by a computer and includes, for example, a CPU 71, a ROM 72 for storing a program for controlling the respective portions, a RAM 73 for temporarily storing data, and an input/output circuit (I/F) 74 through which signals are inputted from and outputted into an external device. The CPU 71 is a microprocessor for managing an entirety of control of the image forming apparatus 1 and is a main body of a system controller. The CPU 71 is connected with the image forming portion 40 and the like via the input/output circuit 74 and not only transfers signals with the respective portions but also controls operations of the respective portions. In the ROM 72, an image forming control sequence for forming the image on the sheet S and the like are stored. The controller 70 is capable of controlling the image forming portion 40, a liquid crystal panel (display portion) 11*a* and a counter portion 60 which are described later. Details of a control system will be described later.

[Image Forming Operation]

Next, the image forming operation of the image forming apparatus 1 constituted as described above will be described. When the image forming operation is started, first, the photosensitive drum 51 is rotated and the surface thereof is electrically charged by the charging roller 52. Then, on the basis of the image information, the laser light is emitted from the exposure device 42 to the photosensitive drum 51, so that the electrostatic image is formed on the surface of the photosensitive drum 51. The toner is deposited on this electrostatic image, whereby the electrostatic image is developed and visualized as the toner image and then the toner image is transferred onto the intermediary transfer belt 44*b*.

On the other hand, the sheet S is fed in parallel to such a toner image forming operation and is conveyed to the secondary transfer portion 45 along a feeding path by being timed to the toner images on the intermediary transfer belt 44*b*. Then, the images are transferred from the intermediary transfer belt 44*b* onto the sheet S. The sheet S is conveyed to the fixing device 46, in which the unfixed toner image is heated and pressed and thus is fixed on the surface of the sheet S, and then the sheet S is discharged from the apparatus main assembly 10.

[Fixing Device]

Figure 3:
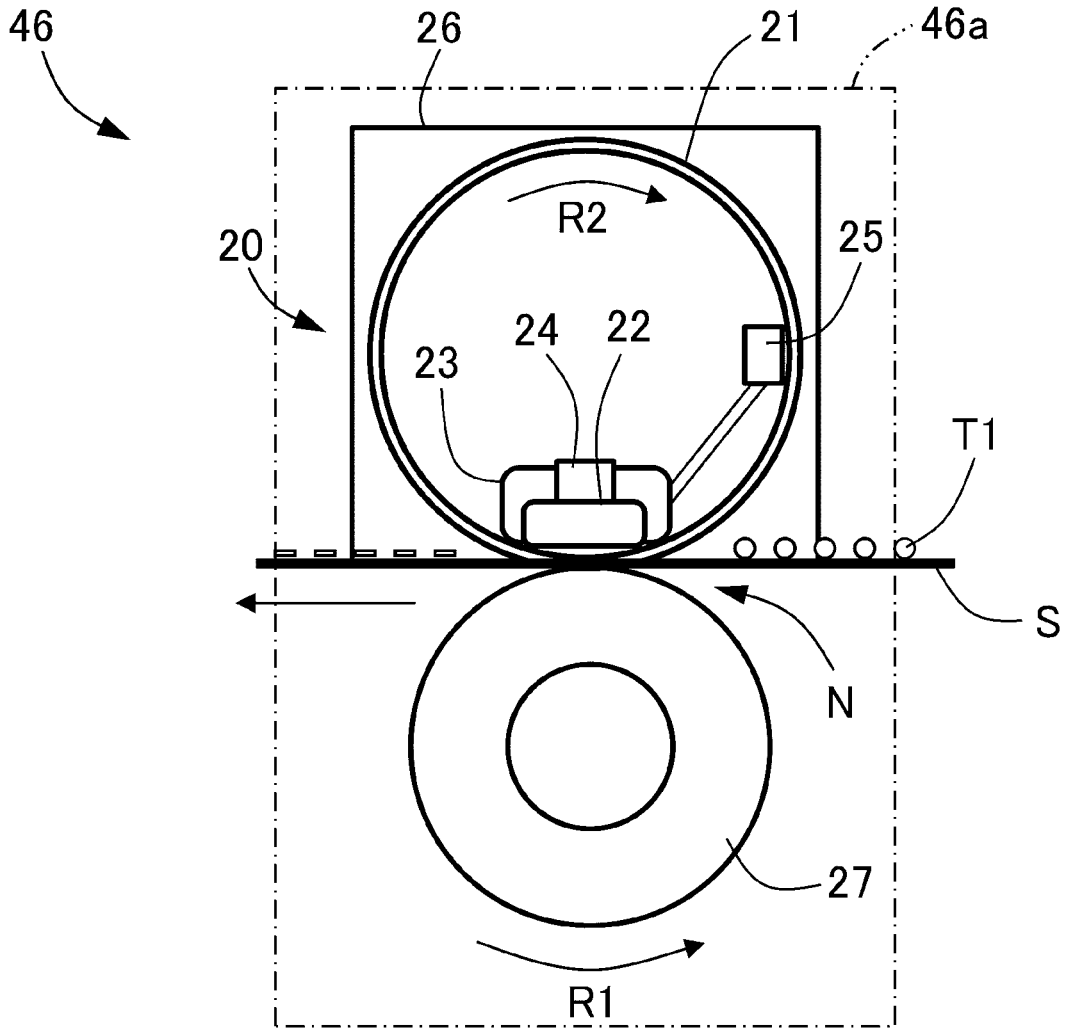
FIG. 3 is a sectional view showing a fixing device of the image forming apparatus according to the embodiment.

Next, a constitution of the fixing device (unit) 46 will be described specifically. As shown in FIG. 3, the fixing device 46 is a heating device of a film feeding type (tensionless type) and is formed in a cartridge shape such that the fixing device 46 is mountable and dismountable from the apparatus main assembly 10. The fixing device 46 includes a casing 46*a*, the fixing film unit (second constituent portion, heating member) 20 and the pressing roller 27. The fixing film unit 20 and the pressing roller 27 are separately mounted in the casing 46*a* from each other so as to be mountable and dismountable from the casing 46*a*. In this embodiment, these members can be exchanged as an entirety of the fixing device 46 relative to the apparatus main assembly 10. Further, relative to the fixing device 46, each of the fixing film unit 20 and the pressing roller 27 can also be exchanged alone. As a result, only a portion which reaches an end of a lifetime thereof and which goes out of order can be exchanged, so that it is possible to suppress a cost of exchange component parts.

The fixing film unit 20 includes the fixing film 21, a heater 22, a heater holder 23, a first thermistor 24, a second thermistor 25, unshown nip forming member and stay, and a flange member 26. The fixing film 21 has a rotatable endless belt shape and a cylindrical shape. The fixing film 21 is externally fitted to the flange member 26 and is rotatably held by the flange member 26. The fixing film 21 is, for example, a film having a composite structure including four layers consisting of a parting layer, an elastic layer, a base layer and an inner surface coat layer in an order from an outer peripheral surface side.

The heater 22 is, for example, a ceramic heater including, as a basic constitution, a thin and elongated ceramic substrate, a resistor layer which is provided on a surface of the ceramic substrate and which generates heat by energization, and a glass layer for protecting the resistor layer. The heater 22 is a low thermal capacity heater increased in temperature by energization to the resistor layer with an abrupt rising characteristic as a whole. The heater 22 is held by the heater holder 23 while facing the pressing roller 27 side. The nip forming member is provided so that the fixing film 21 and the pressing roller 27 form a fixing nip N. The flange member 26 is provided so that opposite end portions of the fixing film 21 are regulated with respect to an axial direction. The stay is disposed on an inner periphery side of the fixing film 21 in order to ensure strength of the nip forming member.

The pressing roller 27 is a heat-resistant elastic roller as a pressing member and includes a core metal and an elastic layer comprising a heat-resistant rubber such as silicone rubber or fluorine-containing rubber or a foam member of silicone rubber, and is provided in a state in which opposite end portions of the core metal are rotatably supported by bearings. On a side on the pressing roller 27, the fixing film 21 and the heater 22 are disposed in parallel to the pressing roller 27, and the pressing roller 27 and the heater 22 are pressed against each other by unshown spring members. As a result, a lower surface of the heater 22 is press-contacted to the fixing film 21 toward an upper surface of the pressing roller 27 against elasticity of the elastic layer of the pressing roller 27, so that the fixing nip N, as a heating portion, having a predetermined width is formed. That is, the pressing roller 27 forms the fixing nip N between itself and the fixing film 21 and is capable of nipping and feeding the sheet S through the fixing nip N.

The pressing roller 27 is rotationally driven in an arrow R1 direction of FIG. 3 at a predetermined rotational speed by rotation of a driving motor 12 (FIG. 2) driven on the basis of a rotation instruction from the controller 70. On the basis of the rotational drive of the pressing roller 27, by a press-contact frictional force in the fixing nip N between the pressing roller 27 and the fixing film 21, a rotational force acts on the cylindrical fixing film 21. The fixing film 21 is rotated by the pressing roller 27 in an arrow R2 direction of FIG. 3 while intimately sliding on the lower surface of the heater 22. Here, the unshown nip forming member supporting the fixing film 21 also functions as a rotation guide member of the cylindrical fixing film 21.

The state in which the heater 22 is energized and is quickly increased in temperature up to a predetermined temperature and is temperature-controlled, the sheet S carrying an unfixed toner image T1 thereon is introduced between the fixing film 21 and the pressing roller 27 in the fixing nip N. Then, the surface of the sheet S where the toner image is carried intimately contacts the outer surface of the fixing film 21, and the sheet S is nipped and fed through the fixing nip N by the fixing film 21 and the pressing roller 27. In this nip-feeding process, the sheet S is heated by heat of the fixing film 21 heated by the heater 22, so that the unfixed toner image T1 on the sheet S is melt-fixed on the sheet S by being heated and pressed. Then, the sheet S passed through the fixing nip N is curvature-separated from the surface of the fixing film 21 and then is fed and discharged.

Incidentally, in this embodiment, a diameter of each of the fixing film 21 and the pressing roller 27 is set at 30 mm. Further, the fixing film 21 and the pressing roller 27 are contacted to each other with a total pressure of 30 kgf, so that about 8 mm is ensured as the width (dimension of the sheet with respect to the feeding direction) of the fixing nip N. Here, a process speed of the image forming apparatus 1 of this embodiment is 250 mm/s, and productivity of A4-size plain paper is 60 ppm for each of monochromatic image formation and color image formation.

The first thermistor 24 is a contact thermometer provided on a back side of the heater 22 and measures a temperature of the heater 22. The second thermistor 25 is a contact thermometer provided on a back side (inside) of the fixing film 21 and measures a temperature of an inner peripheral surface of the fixing film 21 heated by the heater 22.

[IC Memory]

An IC memory (second storing portion) 30 provided to the fixing film unit 20 will be described on the basis of FIG. 2. The IC memory is a non-volatile IC memory and is provided to the fixing film unit 20. Accordingly, when the fixing film unit 20 is exchanged relative to the fixing device 46, the non-volatile IC memory 30 is also exchanged, but even when only the pressing roller 27 is exchanged relative to the fixing device 46, the IC memory 30 is not exchanged. The IC memory 30 is provided to the fixing film unit 20 and stores predetermined information on the fixing film unit 20. In a storage area of the IC memory 30, ID 31 which is an identification number of the fixing film unit 20, an IC counter 32 for counting the number of sheets which passed through the fixing nip N, a shipping form flag 33 indicating a shipping form from a factory, and a new article detecting flag 34 are stored.

The ID 31 is the identification number of the fixing film unit 20 and is stored during factory shipment. The IC counter 32 is capable of being used for lifetime discrimination of the fixing film unit 20. The IC counter 32 is 0 during the factory shipment but is counted by the controller 70 every time when the sheet S passes through the fixing nip N after the fixing device 46 is mounted in the image forming apparatus 1. That is, the IC memory 30 stores a second amount which is an amount relating to an operating time of the fixing film unit 20. In this embodiment, the operating time includes not only a traveling time of the sheet S but also a blank rotation (idling) time of the fixing film 21. In this embodiment, the second amount includes an amount relating to a traveling distance of the sheet S in the fixing device 46 and includes the number of sheets of the IC counter 32 which is an amount relating to the number of image formation sheets by the image forming portion 40. Incidentally, in this embodiment, the second amount is the number of image formation sheets.

The shipping form flag 33 will be described. In this embodiment, as exchange component parts relating to the fixing device 46, an entirety of the fixing device 46, the fixing film unit 20 alone and the pressing roller 27 alone exist. Also as regards the shipping form from the factory, the entirety of the fixing device 46, the fixing film unit 20 alone and the pressing roller 27 alone exist. For this reason, as regards the fixing film unit 20 correspondingly to the shipping form, the shipping form flag 33 is made different and stored, so that it becomes possible to discriminate whether the fixing film unit 20 has been shipped alone or in the form in which the fixing device 46 is mounted in the fixing device 46. Specifically, the shipping form flag 33 is defined, for example, as 0: shipment as the fixing film unit 20 and 1: shipment as the fixing device 46, and depending on a factory shipping form, the above-described value is stored in the IC memory 30 and then is shipped. That is, the IC memory 30 stores information on the shipping form of the fixing film unit 20.

The new article detecting flag 34 is a flag indicating whether or not the fixing film unit 20 is in a new article (brand-new) state. Specifically, the new article detecting flag 34 is defined, for example, as 0: new article and 1: after start of use. The new article detecting flag 34 during factory shipment is 0. That is, the IC memory 30 stores information on a use state of the fixing film unit 20. For example, when the fixing device 46 or the fixing film unit 20 is mounted in the image forming apparatus 1, the controller 70 rewrites the new article detecting flag 34 of the IC memory 30 from 0 to 1. Incidentally, timing of rewriting of the new article detecting flag 34 is not limited thereto, and may also be timing when the IC counter 32 is changed from 0 to 1. In this case, even in the case where the fixing device 46 or the fixing film unit 20 is mounted in the image forming apparatus 1 and then is dismounted without being used, the new article detecting flag 34 can be maintained at 0 as it is.

[Control System]

A control system of the image forming apparatus 1 of this embodiment will be described on the basis of a control black diagram of FIG. 2. To the controller 70, for example, an operating portion 11, a driving motor 12, a communicating portion 13 and a counter portion 60 are connected. The operating portion 11 includes, for example, a liquid crystal panel (output portion) 11*a* capable of outputting information and is provided so that information on, for example, a kind or the like of the sheet S to be used is capable of being inputted from an external device to the CPU 71 by inputting data through an operation by a user. Further, by operating the operating portion 11, when a component part is exchanged, the counter can be manually reset.

The communicating portion 13 is connected to a network 100 and is connected, via the network 100, to an information terminal 101, for example, a receiver which is carried by a service person and which is used for monitoring a state of the image forming apparatus 1. As a result, in the case where a component part during use in the image forming apparatus 1 reaches an end of a lifetime thereof, it is possible to notify information thereof to the information terminal 101 of the service person.

The counter portion 60 includes a fixing device counter (counter for an image heating device) 61, a film unit counter (counter for an image heating unit) 62 and a pressing roller counter (counter for a rotatable pressing member) 63 and is capable of counting the number of sheets passed through the respective component parts. The fixing device counter 61 stores a third amount which is an amount relating to an operating time of the fixing device 46. In this embodiment, the third amount includes an amount relating to a traveling distance of the sheet S in the fixing device 46 and includes the number of sheets of the fixing device counter 61 which is an amount relating to the number of image formation sheets by the image forming portion 40. Incidentally, in this embodiment, the third amount is the number of image formation sheets. The fixing device counter 61 can be used for lifetime discrimination of the fixing device 46. The pressing roller counter 63 stores a first amount which is an amount relating to an operating time of the pressing roller 27. In this embodiment, the first amount includes an amount relating to a traveling distance of the sheet S in the fixing device 46 and includes the number of sheets of the pressing roller counter 63 which is an amount relating to the number of image formation sheets by the image forming portion 40. Incidentally, in this embodiment, the first amount is the number of image formation sheets. The pressing roller counter 63 can be used for lifetime discrimination of the pressing roller 27. The film unit counter 62 is synchronized with the IC counter 32 of the IC memory 30. For this reason, when the fixing device 46 is mounted in the apparatus main assembly 10, a value of the IC counter 32 is written in the film unit counter 62, and with image formation, for example, values of both the IC counter 32 and the film unit counter 62 are increased.

The CPU 71 counts up (increments) the fixing device counter 61, the film unit counter 62, the pressing roller counter 63 of the counter portion 60, and the IC counter 32 of the IC memory 30 by 1 for one sheet subjected to the image formation. Incidentally, the fixing device 46 including the IC memory 30 in which the new article detecting flag 34 is 0 is mounted in the image forming apparatus 1, the CPU 71 rewrites the new article detecting flag 34 from 0 to 1. In the case where the fixing device 46 in which the new article detecting flag 34 is 1 is mounted in the image forming apparatus 1, the new article detecting flag 34 is kept at 1 as it is.

The CPU 71 makes reference to the counter portion 60, and when either one of the fixing device 46, the fixing film unit 20 and the pressing roller 27 reaches a lifetime set number of sheets, the CPU 71 causes the liquid crystal panel 11*a* to display that the associated component part reached an end of a lifetime thereof. Further, the CPU 71 outputs, via the network 100, information to the communicating portion 13, and the communicating portion 13 sends the information to the information terminal 101 carried by the service person and thus notifies the service person of that the associated component part reached the end of the lifetime thereof. The liquid crystal panel 11*a* outputs information prompting exchange of the pressing roller 27 in the case where the first amount relating to the pressing roller 27 reached a predetermined lifetime amount, i.e., in the case where the number of image formation sheets reached a lifetime number of sheets. The liquid crystal panel 11*a* outputs information prompting exchange of the fixing device 46 in the case where the third amount relating to the fixing device 46 reached a predetermined lifetime amount, i.e., in the case where the number of image formation sheets reached a lifetime number of sheets.

Here, as regards the component part including the IC memory 30, when storing contents of the IC memory 30 are developed into the counter portion 60 of the apparatus main assembly 10 during the exchange, there is no difference between the counter and an actual number of sheets passed through the fixing device 46. However, when the IC memory 30 is provided to all the component parts, an increase in cost of the component parts is invited. For that reason, in this embodiment, the IC memory 30 is mounted on the fixing film unit 20, but the pressing roller is not provided with an IC memory. Therefore, as regards the fixing film unit 20, the IC counter 32 and the actual number of sheets passed coincide with each other, but the pressing roller 27 is not provided with the IC memory, and therefore, there is a possibility that forgetfulness to reset the counter during the exchange occurs. When the image forming apparatus 1 is continuously used in a state in which the counter is forgotten to be reset, there is a liability that a value of a counter of the number of sheets passed which is an index of the lifetime discrimination is different from an actual value and thus the lifetime cannot be accurately discriminated. For example, although the pressing roller 27 is just exchanged, display for prompting the exchange is made, so that the pressing roller 27 is wastefully exchanged and thus a component part cost increases. Further, when the component part is continuously used without making reference to the counter, there is a possibility that the component part goes out of order, and when the component part goes out of order, the image forming operation is prohibited, so that there is a liability that downtime of the user is caused to occur.

Therefore, in this embodiment, the CPU 71 makes reference to values of the shipping form flag 33 and the new article detecting flag 34 of the IC memory 30 of the fixing film unit 20. Then, in the case where the shipping form flag 33 is 1 and the new article detecting flag 34 is 0, the CPU 71 resets the pressing roller counter 63 and the fixing device counter 61 of the counter portion 60. That is, in the case where the fixing device 46 including the pressing roller 27 and the fixing film unit 20 which are not used after shipment is mounted in the apparatus main assembly 10, the controller 70 automatically resets the first amount stored in the pressing roller counter 63.

Further, in this embodiment, in the case where the fixing device 46 including the pressing roller 27 and the fixing film unit 20 at least one of which is used after the shipment is mounted in the apparatus main assembly 10, the controller 70 performs the following operation. That is, in this case, the controller 70 does not automatically reset the first amount stored in the pressing roller counter 63. Further, the controller 70 does not automatically reset the first amount stored in the pressing roller counter 63 even in the case where the third amount stored in the fixing device counter 61 is reset.

Further, in this embodiment, in the case where the shipping form flag 33 is 0, i.e., in the case where the shipping form is the fixing film unit 20 alone, the controller 70 does not automatically reset the first amount stored in the pressing roller counter 63. In the case where the new article detecting flag 34 is 1, i.e., in the case where the fixing film unit 20 is used after the shipment, the controller 70 does not automatically reset the first amount stored in the pressing roller counter 63. On the other hand, in the case where the shipping form flag 33 is 1, i.e., the shipping form is the fixing device 46 and the new article detecting flag 34 is 0, i.e., the fixing film unit 20 is not used after the shipment, the controller 70 performs the following operation. That is, in this case, the controller 70 automatically resets the first amount stored in the pressing roller counter 63.

Figure 4:
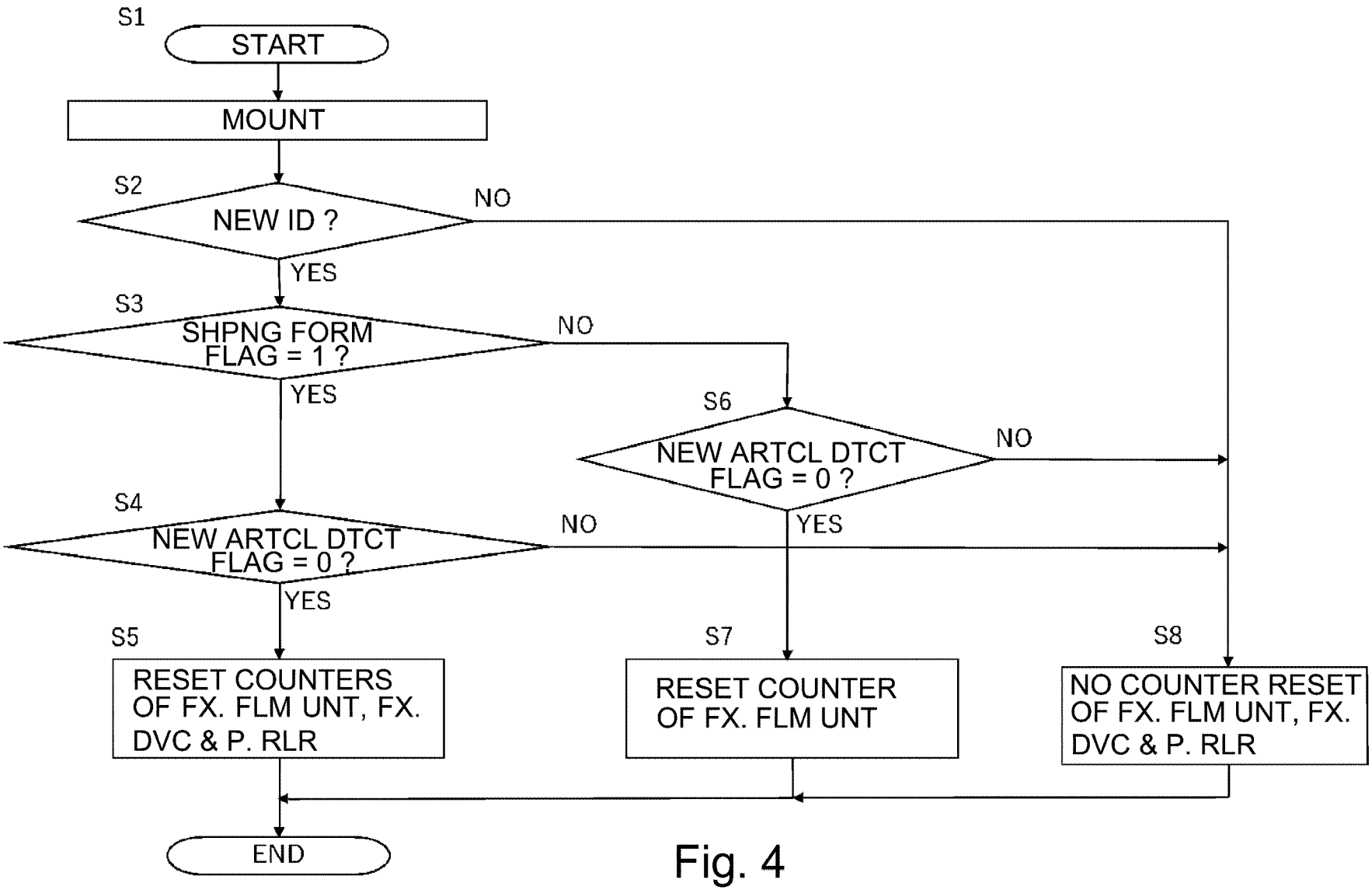
FIG. 4 is a flowchart showing a procedure of a process in the case where the fixing device is mounted in the image forming apparatus according to the embodiment.

Next, a process procedure when the fixing device 46 or the fixing film unit 20 is exchanged in the image forming apparatus 1 of this embodiment will be described along a flowchart of FIG. 4. First, the CPU 71 detects that the fixing device 46 or the fixing film unit 20 is mounted in the apparatus main assembly 10 (step S1). The CPU 71 makes reference to the ID 31 in the IC memory 30 of the mounted fixing device 46 an then discriminates whether or not the ID currently referenced is new relative to the LD last stored in the IC memory included in the apparatus main assembly 10 (step S2). In the case where the CPU 71 discriminated that the current ID is not new relative to the last ID (NO of step S2), at least the fixing film unit 20 is not exchanged. For this reason, the CPU 71 does not reset either of the fixing device counter 61, the film unit counter 62 and the pressing roller counter 63 (step S8), and ends the process so as to continue the count values which have already been stored. Incidentally, as an example of this case, for example, the case where the fixing device 46 is once dismounted and then is mounted again without being mounted and the case where the fixing film unit 20 is not exchanged but only the pressing roller 27 is exchanged correspond. In either case, there is no need to reset the fixing device counter 61, the film unit counter 62 and the pressing roller counter 63.

In the case where the CPU 71 discriminated that the current ID is new relative to the last ID (YES of step S2), at least the fixing film unit 20 is exchanged. Incidentally, the fixing film unit 20 has counter information in the IC memory 30, and therefore, when the CPU 71 discriminates that the ID is new, the IC counter 32 in the IC memory 30 is developed into the film unit counter 62 of the counter portion 60, and then count up is started. The CPU 71 makes reference to the shipping form flag 33 and discriminates whether or not the shipping form flag 33 is 1, i.e., whether or not shipment as the fixing device 46 is made (step S3). In the case where the shipping form flag 33 is 1, the shipment is made as the fixing device 46 (YES of step S3), and in the case where the shipping form flag 33 is 0, the shipment is made as the fixing film unit 20 alone (NO of step S3).

In the case where the CPU 71 discriminated that the shipping form flag 33 is not 1 (NO of step S3), the CPU 71 discriminates that shipment as the fixing film unit 20 is made. The CPU 71 makes reference to the new article detecting flag 34 and discriminates whether or not the new article detecting flag 34 is 0, i.e., whether or not the fixing film unit 20 is a new article (step S6). In the case where the new article detecting flag 34 is 0, the CPU 71 discriminates that the fixing film unit 20 is the new article (YES of step S6). In this case, the CPU 71 does not reset the fixing device counter 61 and the pressing roller counter 63, but resets the film unit counter 62 (step S7). For this reason, the CPU 71 does not reset either of the fixing device counter 61 and the pressing roller counter 63 (step S7), and ends the process so as to continue the count values which have already been stored. Incidentally, as an example of this case, for example, the case where only the fixing film unit 20 is exchanged and the pressing roller 27 and the casing 46 are not exchanged corresponds. In this case, there is no need to reset the fixing device counter 61 and the pressing roller counter 63.

In the case where the CPU 71 discriminated that the shipping form flag 33 is 1 (YES of step S3), the CPU 71 discriminates that shipment as the fixing device 46 is made and then makes reference to the new article detecting flag 34, and thus discriminates whether or not the new article detecting flag 34 is 0, i.e., whether or not the fixing device 46 is a new article (step S4). In the case where the CPU 71 discriminated that the new article detecting flag 34 is not 0 (NO of S4), the CPU 71 discriminates that the fixing device 46 which is not the new article and which has already been started to be used is mounted in the apparatus main assembly 10. For this reason, the CPU 71 does not reset either of the fixing device counter 61, the film unit counter 62 and the pressing roller counter 63 (step S8), and ends the process so as to continue the count values which have already been stored.

Further, in the case where the CPU 71 discriminated that the new article detecting flag 34 is 0 (YES of S4), the CPU 71 discriminates that the fixing device 46 which is the new article is mounted in the apparatus main assembly 10. For this reason, the CPU 71 automatically reset all the fixing device counter 61, the film unit counter 62 and the pressing roller counter 63 so that their count values start from 0 (step S5), and then ends the process. As a result, it is possible to prevent the respective counters from being forgotten to be reset. Incidentally, the IC counter 32 is 0 from before mounting.

Specific Embodiment

Next, a specific embodiment in the case where the image forming apparatus of this embodiment will be described specifically. In this case, as an example, the lifetime number of sheets used for image formation using the fixing film unit 20 is 300,000 sheets in terms of A4 size sheets. The lifetime number of sheets is 300,000 sheets for the pressing roller 30 and is 500,000 sheets for the fixing device 46. Further, at present, it is assumed that the image forming apparatus 1 is in a state in which 200,000 sheets are used for each of the fixing device 46, the fixing film unit 20 and the pressing roller 27. Accordingly, each of fixing device counter 61, the film unit counter 62 and the pressing roller counter 63 indicates 200,000 sheets. In this state, each of the cases where the exchanging operations were performed in the following manners will be described.

First, the case where the fixing device 46 is exchanged with the fixing device 46 which is a new article will be described. In this case, the fixing device 46 is the new article, and therefore, the shipping form flag 33 is 1 (YES of step S3) and the new article detecting flag 34 is 0 (YES of step S4). For this reason, the CPU 71 automatically resets the fixing device counter 61, the film unit counter 62 and the pressing roller counter 63 to 0 or the like. Accordingly, in this embodiment, an object to be exchanged is the fixing device 46, and when the fixing device 46 is the new article, the pressing roller counter 63 for the pressing roller 27 is automatically reset.

Next, the case where the fixing film unit 20 is exchanged with the fixing film unit 20 which is a new article will be described. In this case, the fixing film unit 20 is the new article, and therefore, the shipping form flag 33 is 0 (NO of step S3) and the new article detecting flag 34 is 0 (YES of step S6). For this reason, the new article detecting flag 34 is reset, while the fixing device counter 61 and the pressing roller counter 63 are not reset and indicate 200,000 sheets as they are.

At this time, for example, in the case where the fixing device 46 including the pressing roller 27 and the fixing film unit 20 which are not used after shipment is mounted in the apparatus main assembly 10, the number of image formation sheets until the pressing roller 27 reaches the end of the lifetime thereof after the mounting is a first lifetime number of sheets (for example, 300,000 sheets). Similarly, the number of image formation sheets until the fixing film unit 20 reaches the end of the lifetime thereof after the mounting is a second lifetime number of sheets (for example, 300,000 sheets). At this time, in the case where the fixing device 46 including the pressing roller 27 which is not used after shipment and including the fixing film unit 20 which is used after shipment is mounted in the apparatus main assembly 10, the controller 70 performs the following operation. In this case, the controller 70 automatically sets the pressing roller counter 63 so that the number of image formation sheets until the pressing roller 27 reaches the end of the lifetime thereof after the mounting is the first lifetime number of sheets (300,000 sheets). On the other hand, the controller 70 can read, from the IC counter 32, a use amount of the fixing film unit 20 after the shipment. On the basis of this, the controller 70 makes setting so that the number of image formation sheets until the fixing film unit 20 reaches the end of lifetime thereof after the mounting is a third lifetime number of sheets (300,000 sheets 200,000 sheets=100,000 sheets) smaller than the second lifetime number of sheets (300,000 sheets).

Next, the case where the fixing device 46 is exchanged with an old fixing device 46 for which 100,000 sheets have already been used will be described. In this case, the fixing device 46 is the old fixing device 46, and therefore, the shipping form flag 33 is 1 (YES of step S3) and the new article detecting flag 34 is 1 (NO of step S4). For this reason, the CPU 71 does not reset the fixing device counter 61, the film unit counter 62 and the pressing roller counter 63, and these counters indicate 200,000 sheets as they are.

Next, the case where the fixing film unit 20 is exchanged with an old fixing film unit 20 for which 100,000 sheets have already been used will be described. In this case, the fixing film unit 20 is the old fixing film unit 20, and therefore, the shipping form flag 33 is 0 (NO of step S3) and the new article detecting flag 34 is 1 (NO of step S6). For this reason, the CPU 71 does not reset the fixing device counter 61, the film unit counter 62 and the pressing roller counter 63, and these counters indicate 200,000 sheets as they are.

As described above, according to the image forming apparatus 1 of this embodiment, even when the pressing roller 27 is the pressing roller 27 which is not provided with an exclusive memory and for which whether or not the pressing roller 27 is the new article cannot be directly detected, the counter can be automatically reset with the exchange the new fixing device 46. That is, even when the pressing roller 27 is the pressing roller 27 mounted so as to be mountable and dismountable from the fixing device 46 without being provided with the storing portion for storing whether or not the pressing roller 27 is the new article, it is possible to suppress forgetfulness to reset the value of the counter for discriminating the lifetime in the case where the pressing roller 27 is exchanged with the new article. Here, in the case where the counter is manually reset during the exchange, there is possibility of forgetfulness to reset the counter. According to the image forming apparatus 1 of this embodiment, in the case where the new fixing device 46 is mounted in the image forming apparatus 1, the counter is automatically reset, so that there is no difference between the counter and the actual number of sheets passed through the fixing device 46 and thus it is possible to prevent occurrences of a waste cost and downtime.

In the image forming apparatus 1 of the above described embodiment, the fixing device including the fixing film unit and the pressing roller was used, but the present invention is not limited thereto. For example, the fixing film unit may also be a fixing belt unit including a halogen heater or a fixing belt unit including an IH portion, and the pressing roller may also be replaced with a rotatable pressing member including a pressing belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-168998 filed on Sep. 10, 2018, which is hereby incorporated by reference herein in its entirety.

What is claimed is:

1. An image forming apparatus comprising:

an image forming portion configured to form a toner image on a recording material;

an image heating apparatus mountable in and dismountable from said image forming apparatus and configured to heat the toner image formed on the recording material, wherein said image heating apparatus includes, i) an image heating unit which is provided in said image heating apparatus so as to be mountable in and dismountable from said image heating apparatus and which includes a rotatable heating member configured to heat the toner image formed on the recording material, ii) a rotatable pressing roller provided in said image heating apparatus so as to be mountable in and dismountable from said image heating apparatus and configured to press said rotatable heating member so as to form a nip in which the recording material is nipped and fed, and iii) an information storing portion provided on said image heating unit so as to be mountable in and dismountable from said image heating apparatus integrally with said image heating unit, a reading portion configured to read information of said information storing portion;

a counter portion configured to count a value relating to a use amount of said image heating apparatus mounted, a value of a use amount of said image heating unit mounted, and a value of a use amount of said rotatable pressing member mounted;

a display portion configured to display a count value of said image heating apparatus, a count value of said image heating unit, and a count value of said rotatable pressing member; and a controller configured to control said counter portion so that when said image heating apparatus mounted is exchanged with an image heating apparatus including a new image heating unit, on the basis of information of said information storing portion, the count value of said image heating unit, the count value of said image heating apparatus and the count value of said rotatable pressing member are reset, and when only said image heating unit mounted is exchanged with a new image heating unit, the count value of said image heating unit is reset and the count value of said rotatable pressing member is not reset.

2. An image forming apparatus according to claim 1, further comprising an input portion configured to manually reset the count value of said rotatable pressing member.

3. An image forming apparatus according to claim 1, wherein in said storing portion, information for discriminating that an exchange part is an exchange part of said image heating unit and that the exchange part is an exchange part of said image heating apparatus is stored.

4. An image forming apparatus according to claim 1, wherein in said storing portion, information for discriminating whether or not said image heating unit is a new article or whether or not said image heating apparatus is a new article is stored.

5. An image forming apparatus according to claim 1, wherein said counter portion counts the number of recording materials which passed through the nip.

6. An image forming apparatus according to claim 5, further comprising a writing portion configured to write information in said storing portion, wherein the information is counted by said counter portion.

7. An image forming apparatus according to claim 1, wherein when the count value of said rotatable pressing member reaches a set value, information for prompting exchange of said rotatable pressing member is displayed on a display portion.

8. An image forming apparatus according to claim 1, wherein when the count value of said image heating unit reaches a set value, information for prompting exchange of said image heating unit is displayed on the display portion.

9. An image forming apparatus according to claim 1, wherein when only said image heating unit mounted is exchanged, the count value of said image heating apparatus is not reset.

10. An image forming apparatus according to claim 1, wherein said rotatable pressing member is a pressing roller.

11. An image forming apparatus according to claim 1, wherein said image heating unit includes a film member and a planar heater configured to heat said film member in contact with an inner surface of said film member, and fixes the toner image on the recording material.

* * * * *